US009568293B1

(12) United States Patent
Palazzolo

(10) Patent No.: US 9,568,293 B1
(45) Date of Patent: Feb. 14, 2017

(54) 40 MM GRENADE CARTRIDGE CARRIER/STRIPPER

(71) Applicant: William J. Palazzolo, Culver City, CA (US)

(72) Inventor: William J. Palazzolo, Culver City, CA (US)

( * ) Notice: Subject to any disclaimer, the term of this patent is extended or adjusted under 35 U.S.C. 154(b) by 961 days.

(21) Appl. No.: 13/986,316

(22) Filed: Apr. 19, 2013

(51) Int. Cl.
*A45F 5/00* (2006.01)
*F42B 39/02* (2006.01)

(52) U.S. Cl.
CPC ..... *F42B 39/02* (2013.01)

(58) Field of Classification Search
CPC ..... F42B 39/02; F42B 39/26; F42B 39/08; F42B 39/082; F42B 39/085; F42B 39/087
See application file for complete search history.

(56) References Cited

U.S. PATENT DOCUMENTS 3,190,514 A * 6/1965 Spilman ..... F42B 39/02 206/3
4,498,612 A 2/1985 Geekie, Jr.
4,502,612 A 3/1985 Morrison
4,843,649 A 7/1989 Jewell et al.
5,284,081 A * 2/1994 Stoner ..... F41A 9/31 42/105
5,755,055 A 5/1998 Thompson et al.
6,000,589 A * 12/1999 Burdine ..... F41A 9/65 221/185
6,202,908 B1 * 3/2001 Groover ..... F42B 39/02 224/236
6,688,504 B1 * 2/2004 Kirkaldy ..... A45F 5/021 224/196
6,898,888 B2 5/2005 Greenhut
7,497,043 B2 * 3/2009 Clifton, Jr. ..... F41A 9/63 224/239
7,533,598 B1 * 5/2009 Murphy ..... F41A 9/41 42/14
7,950,176 B1 * 5/2011 Nemtyshkin ..... F41H 13/0025 361/232
8,261,666 B2 9/2012 Garg
8,800,422 B2 * 8/2014 Norton ..... F41A 3/26 42/16
2004/0222258 A1 * 11/2004 Ho ..... A45F 5/022 224/191
2011/0132780 A1 * 6/2011 Marconi ..... F41A 9/65 206/3
2013/0270311 A1 * 10/2013 Sitz ..... F41A 23/18 224/255

* cited by examiner

*Primary Examiner* — Derek Battisti
(74) *Attorney, Agent, or Firm* — Gordon K. Anderson

(57) ABSTRACT

The present invention relates to a combined carrier and stripper for a 40 MM grenade cartridge allowing transportation and ready access to a number of cartridges while permitting manual removal of a single cartridge also maintaining the remainder for further use. The carrier/stripper consists of a pair of spaced inwardly facing structural channels, each having a closed end, held together with a connecting plate member with release members retaining a number of cartridges providing securement with easy access for manual removal. The device provides attachment to a person achieved with either a spring loaded clasp, a belt clip or hook and loop tape with straps removeably attached on a mat.

15 Claims, 2 Drawing Sheets

40 MM GRENADE CARTRIDGE CARRIER/STRIPPER

CROSS REFERENCE TO RELATED APPLICATION

This application claims priority of Provisional Patent Application Ser. No. 61/687,249 filed Apr. 23, 2012.

TECHNICAL FIELD

The present invention relates to a combined carrier and stripper for a 40 MM grenade cartridge consisting of a pair of spaced inwardly facing structural channels and release members retaining a number of cartridges providing securement with easy access for manual removal.

BACKGROUND ART

Previously, many types of cadies, shell holders, strippers and carriers have been used in endeavoring to provide an effective means to store and wear on a person's body to provide rapid and speedy access when necessary for use.

The prior art listed below did not disclose patents that possess any of the novelty of the instant invention; however the following U.S. patents are considered related:

| Pat. No. | Inventor | Issue Date |
|---|---|---|
| 4,498,612 | Geekie, Jr. | Feb. 12, 1985 |
| 4,502,612 | Morrison | Mar. 5, 1985 |
| 4,843,649 | Jewell deceased et al. | Jul. 4, 1989 |
| 5,755,055 | Thompson et al. | May 26, 1998 |
| 6,898,888B2 | Greenhut | May 31, 2005 |
| 7,533,598B1 | Murphy | May 19, 2009 |
| 8,261,666B2 | Garg | Sep. 11, 2012 |

Geekie, Jr. in U.S. Pat. No. 4,498,612 teaches a belt buckle adapted for use as a cartridge or shotgun shell holder. The buckle has attached to its front side three parallel rows of spring clips arranged to hold up to three conventional cartridges or shotgun shells horizontally across the buckle. The buckle also has a shield to protect the ammunition while providing a brace and pivot point for removal.

U.S. Pat. No. 4,502,612 issued to Morrison is for a dispensing container for providing articles one at a time. A delivery throat forming a continuous extension of the body, which has a cross section proximate to the cross section of the articles disposed Therein. to serially align the article passing through. The throat is formed with an upturned end defining a lower trap portion adjacent to the end which permits only one article at a time to be moved to the end of the throat.

Jewell et al. in U.S. Pat. No. 4,843,649 disclose a shotgun shell holder and dispenser mounted on a hunting vest having a plurality of upright loops for accommodating shotgun shells in an end-to-end relation. A dispenser comprises a tube located in the bottom of each loop. Flexible retaining structure on the bottom of each tube releaseably holds the shells in the tubes and loops.

Thompson et al. in U.S. Pat. No. 5,755,055 teaches a holder foe a gun having an elongated cylindrical side wall, a bottom wall and an open top end and a cap having a cylinerrial side wall which is ensleeved over the side wall of the body. The holder has the shape and size of a shot gun shell and is stored in a chamber in the stock of a gun.

Murphy in U.S. Pat. No. 7,533,598 B1 discloses a shell stripper assembly which includes a stripper guide, a stripper guide plate and a magazine insert. The shell stripper strips the top round from the firearm magazine enabling it to be picked up by the firearm breech bolt. The shell stripper slides between guide rails of the stripper guide and is position controlled by the stripper guide plate.

U.S. Pat. No. 8,261,666 B2 issued to Garg is for a non-lethal projectile storage and charging mechanism. An ammunition cartridge includes a propulsion mechanism and an non-lethal projectile. The non-lethal projectile is configured to detach from a launching device when propelled from the launching device and includes a set of electrodes coupled to an electrical power source which may be a capacitor, a battery or a combination thereof. The cartridge may be shaped and sized for firing from a weapon designed to fire comparably shaped and sized conventional ammunition.

For background purposes and as indicative of the art to which the invention is related reference may be made to the remaining cited U.S. Pat. No. 6,898,888 B2 issued to Greenhut.

DISCLOSURE OF THE INVENTION

In the past 40 MM grenade cartridges have been stored and carried by the armed forces using pouches, bags and pockets for immediate use by individual personnel. While this method of transportation and use is appropriate, it does not give the person ready access to the ammunition when needed in an urgent situation. It has therefore been a long felt need to have a device that is reachable as well as being quick and swift to retrieve the grenade at the time of need.

The primary object of the invention fills this need completely as the 40 MM grenade cartridges are stored in a stripper that retains their position and yet is extremely fast as the user simply grasps the top cartridge between the thumb and finger and lifts upwardly where the retaining member easily releases the cartridge for use without fumbling or any further hand manipulation required.

Another object of the invention is in the attaching of the carrier and stripper to a person which it is accomplished by using a number of methods required by the actual application, which include a belt clip, a spring loaded wire form clasp or a detachable hook and loop tape member for release with straps, or the like, all of which provide attachment to a person or an object.

An important object of the invention is that the carrier and stripper may be fabricated to carry any number of grenade cartridges by simply changing the length of the side members and connecting plate. While only three embodiments are described and illustrated the remainder of the elements and attachment means remain the same.

Another object of the invention is its simplicity, as it is fabricated using two opposed channel shaped members with a flat connecting plate which are fabricated using well known state of art equipment and sturdy and light weight personnel attachment methods.

Still another object of the invention is directed to the material for the channels and connecting plate which may be either metal or thermoplastic in either combination both materials are sufficiently strong and yet light enough in weight.

Yet another object of the invention is that almost all of the various grenade cartridges fit into the invention with ease, as the size and configuration is mandated by their basic design and interchangeability with various weapons.

A final object of the invention is that the side channels are configured to accept the base of the cartridge against the inside surface of the web which is flat and their tolerances permit the cartridges to slide within the device without binding, as happens frequently many in spring loaded firearm magazines.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
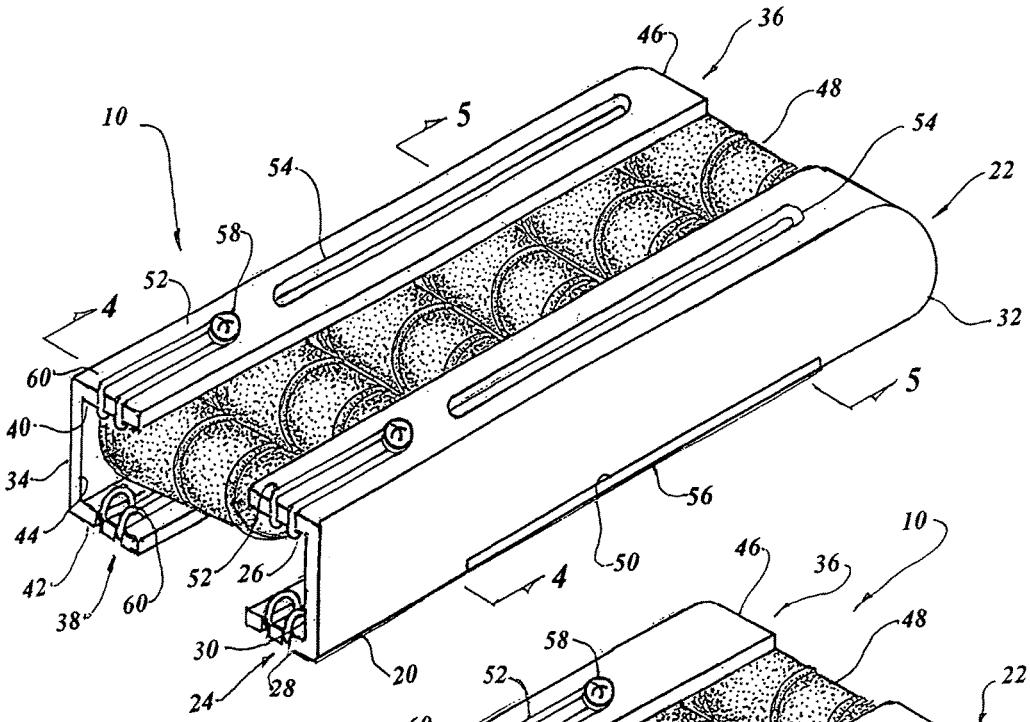
FIG. 1 is a partial isometric view of the carrier and stripper having a capacity of six cartridges in the preferred embodiment.

The best mode for carrying out the invention is presented in terms of a preferred embodiment. This preferred embodiment is shown in FIGS. 1 thorough 14 and is comprised of a carrier and stripper 10 for 40 MM grenade cartridges which consists of a channel shaped right side member 20 having a closed end 22, an open end 24, a top leg 26, a bottom leg 28 and a web 30. The closed end 22 has a radial portion that integrally connects the top leg 26 with the bottom leg 28 forming a semi-circular extremity 32.

Likewise the carrier and stripper 10 incorporate a channel shaped left side member 34 having a closed end 36, an open end 38, a top leg 40, a bottom leg 42 and a web 44. The closed end 36 has a radial portion that integrally connects the top leg 40 with the bottom leg 42 forming a semi-circular extremity 46.

The right side member 20 and left side member 34 are positioned opposite each other with the right top legs 26 and bottom legs 28 facing the left top legs 40 and bottom legs 42. The inside surface of the webs 30 and 44 are spaced apart slightly over the total overall length of a 40 MM grenade cartridge 48 providing a clearance for the cartridge 48 to slide freely between the webs 30 and 44. The legs 26, 28, 40 and 42 are configured to retain the cartridge 48 with sufficient room to allow rolling or sliding the cartridge 48 between the legs.

The channel shaped right and left side member 20 and 34 are preferably formed of aluminum, in the 6061 alloy with T6 temper or equivalent. Optionally the material may preferably be 20% fiberglass reinforced thermoplastic, known by its trademark name DELRIN®, or a similar thermoplastic material.

The overall length of the right and left side member 20 and 34 is determined by the number of 40 MM grenade cartridges 48 to be housed therein which are basically unlimited only by its practical ability. As and example FIG. 1 illustrates a configuration to retain six 40 MM grenade cartridges 48, FIG. 2 depicts a configuration to retain three 40 MM grenade cartridges 48 and FIG. 3 shows a configuration to retain two 40 MM grenade cartridges 48.

Figure 2:
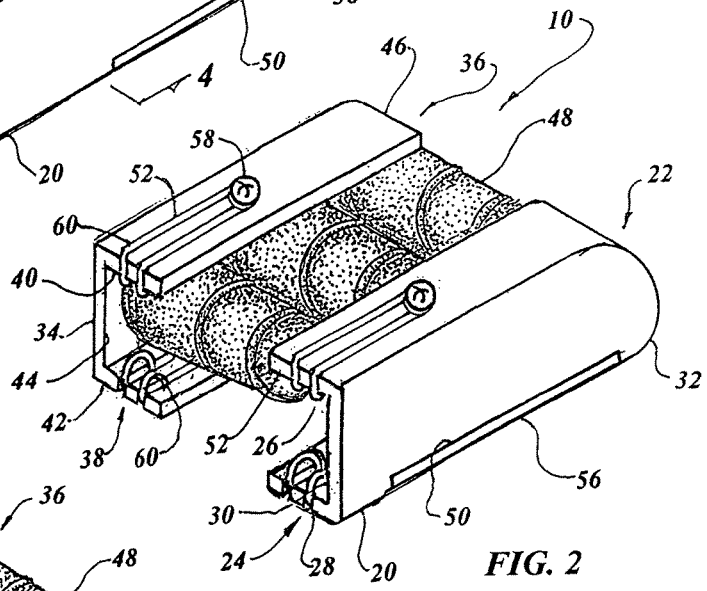
FIG. 2 is a partial isometric view of the carrier and stripper having a capacity of three cartridges in the preferred embodiment.
Figure 3:
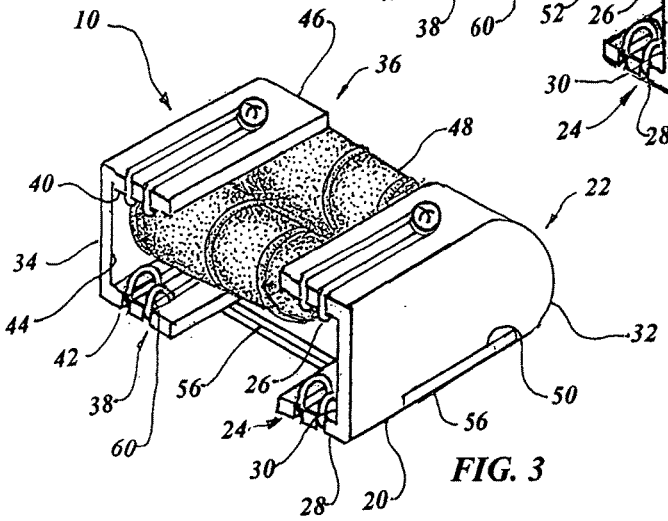
FIG. 3 is a partial isometric view of the carrier and stripper having a capacity of two cartridges in the preferred embodiment.
Figure 4:
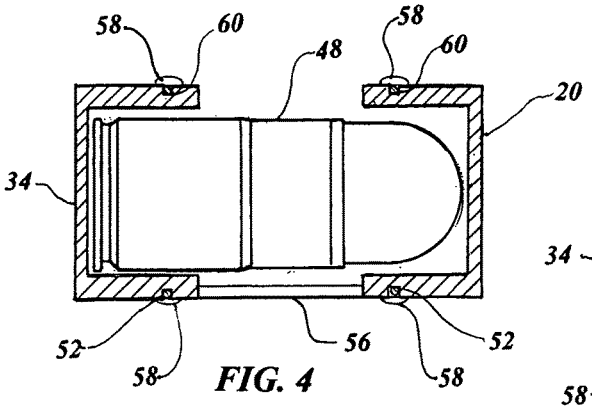
FIG. 4 is a cross sectional view taken along lines 4-4 of FIG. 1.
Figure 5:
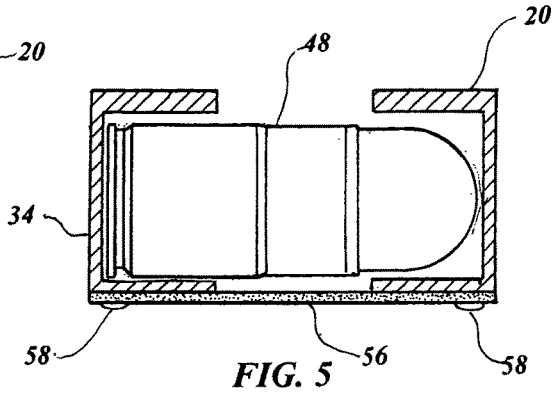
FIG. 5 is a cross sectional view taken along lines 5-5 of FIG. 1.

The bottom leg 28 of the right side member 20 and the bottom leg 42 of the left side member 34 each contain a notch 50 on an outside surface, as illustrated best in FIGS. 1-3. Both the top legs 26 and 40 and the bottom legs 28 and 42 contain stripper slots 52 in both the top and bottom legs 26, 28, 40 and 42 as illustrated in FIGS. 1 through 4.

The top legs 26 and 40 optionally may include a lightening slot 54, as shown in FIGURE, 1, to decrease the weight of the carrier/stripper 10.

Figure 6:
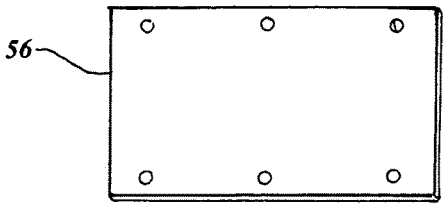
FIG. 6 is a partial isometric view of the six cartridge capacity connecting plate in the preferred embodiment.
Figure 7:
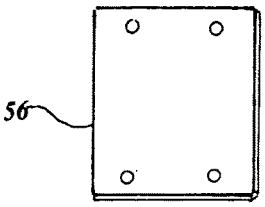
FIG. 7 is a partial isometric view of the three cartridge capacity connecting plate in the preferred embodiment.
Figure 8:
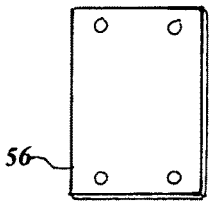
FIG. 8 is a partial isometric view of the two cartridge capacity connecting plate in the preferred embodiment.

A connecting plate member 56, as illustrated separately in FIGS. 6-8, attaches the right side member 20 to the left side member 34 in the notches 50, located in the bottom legs 28 and 42, with threaded fasteners 58, as depicted in FIGS. 1-3 and 5. The connecting plate member 56 is also preferably formed of aluminum, in the alloy 6061 with the T6 temper, and the like, or optionally of preferably 20% fiberglass reinforced acetyl homo-polymer thermoplastic resin, known by its trademark name DELRIN, or a similar thermoplastic resin material. It should be understood that the material of the right and left side member 20 and 34 and connecting plate member 56 may be either the same or used in combination with equal ease.

At least one retaining and release member have a configuration to retain the plurality of 40 MM grenade cartridges 48 between the right side member 20 and the left side member 34 and each closed end 22 and 36 until released by manually pulling out one of the grenade cartridges 48 from the end opposite each closed end 22 and 36.

Figure 9:
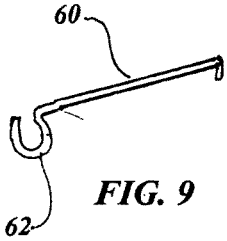
FIG. 9 is a partial isometric view of the retaining and release member in the wire form spring embodiment.

The retaining and release member may include a plurality of wire form stripper springs 60 imbedded in the stripper slots 52 in the top and bottom legs 26, 28, 40 and 42 as illustrated in FIGS. 1-4, and depicted alone in FIG. 9. The wire form stripper springs 60 are formed of spring steel, preferably stainless steel and include a loop 62 on one end that interfaces and retains the 40 MM grenade cartridges 48 top and bottom, with the spring action permitting the cartridges 48 to be removed from the open top of the carrier/stripper 10 easily. The stripper springs 60 are retained in the stripper slots 52 with threaded fasteners 58 as shown pictorially in FIGS. 1 and 4.

Figure 10:
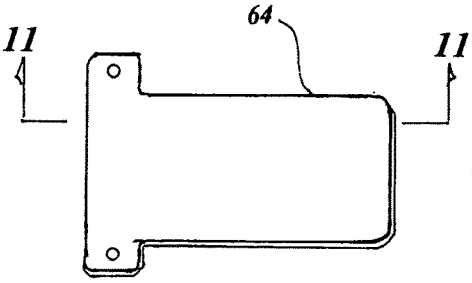
FIG. 10 is a partial isometric plan view of the retaining and release member in the leaf spring embodiment.
Figure 11:
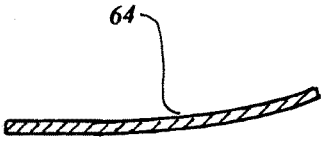
FIG. 11 is a cross sectional view taken along lines 11-11 of FIG. 10.

Optionally a leaf spring 64, illustrated separately in FIGS. 10 and 11, may be used to retain and strip the cartridges 48 particularly in the smaller capacity carrier/stripper 10 as illustrated in FIGS. 2 and 3. The leaf spring 64 may be attached with the threaded fasteners 58, well known in the art.

Figure 12:
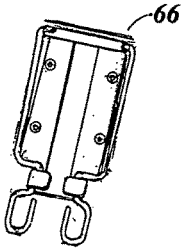
FIG. 12 is a partial isometric view of the attaching means in the spring loaded wire form clasp embodiment.
Figure 13:
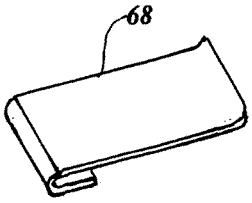
FIG. 13 is a partial isometric view of the attaching means in the belt clip embodiment.
Figure 14:
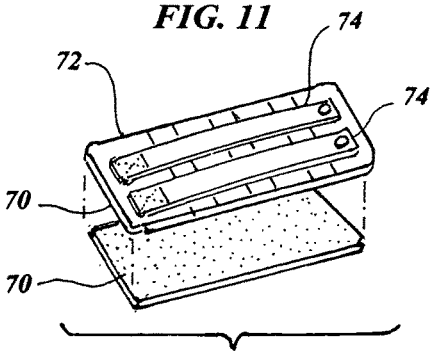
FIG. 14 is an exploded isometric view of attaching means in the hook and loop embodiment with straps.

Attaching means are included for fastening the carrier and stripper 10 to a person which may include a spring loaded wire form clasp 66, illustrated in FIG. 12 or a belt clip 68, shown in FIG. 13, formed of stainless spring steel. The larger capacity carrier/stripper 10 may utilize hook and loop tape 70 attached with the loop side to the connecting plate member 56 and the hook side adhered to a material mat 72 having straps 74 sewn to the outside surface, as illustrated in FIG. 14.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

ELEMENT DESIGNATION

For Convenience of the Examiner, not Part of the Specification

10 carrier/stripper
20 right side member
22 closed end (of 20)
24 open end (of 20)
26 top leg (of 20)
28 bottom leg (of 20)
30 web (of 20)
32 semi-circular extremity (of 22)
34 left side member
36 closed end (of 34)
38 open end (of 34)
40 top leg (of 34)
42 bottom leg (of 34)
44 web (of 34)
46 semi-circular extremity (of 36)
48 40 MM grenade cartridge
50 notch (in 28 & 42)
52 stripper slots (in 20 & 34)
54 lightening slots (in 26 & 40)
56 connecting plate member
58 threaded fastener
60 wire form stripper spring
62 loop (in 60)
64 leaf spring
66 wire form clasp
68 belt clip
70 hook and loop tape
72 material mat
74 straps (on 72)

The invention claimed is:

1. A carrier and stripper for a 40 MM grenade cartridge which comprises:

a channel shaped right side member having a closed end, an open end, a top leg, a bottom leg and a web, a channel shaped left side member having a closed end and a open end, a top leg, a bottom leg and a web with each of said legs facing said legs of said right side member with said webs spaced at a predetermined distance, a separate and distinct connecting plate member attaching said right side member to said left side member on facing bottom legs, at least one retaining and release member having a configuration to retain a plurality of 40 MM grenade cartridges between said right side member and said left side member, and each closed end until released by manually pulling out one of said grenade cartridges from an end opposite each closed end, wherein said channel shaped right side member and said channel shaped left side member have a plurality of slots for retaining said least one retaining and release member, and attaching means for fastening said carrier and stripper to a person.

2. The carrier and stripper for a 40 MM grenade cartridge as recited in claim 1 wherein said channel shaped right side member and channel shaped left side member are fabricated of an aluminum material.

3. The carrier and stripper for a 40 MM grenade cartridge as recited in claim 1 wherein said channel shaped right side member and channel shaped left side member are fabricated with a thermoplastic resin.

4. The carrier and stripper for a 40 MM grenade cartridge as recited in claim 1 have a configuration capable of retaining at least six 40 MM grenade cartridges.

5. The carrier and stripper for a 40 MM grenade cartridge as recited in claim 1 wherein said channel shaped right side member and said channel shaped left side member are notched on each bottom leg to interface with said connecting plate member.

6. The carrier and stripper for a 40 MM grenade cartridge as recited in claim 1 wherein said channel shaped right side member and said channel shaped left side member have a plurality of lightening slots in said top leg.

7. The carrier and stripper for a 40 MM grenade cartridge as recited in claim 1 wherein said connecting plate member is fabricated of an aluminum alloy.

8. The carrier and stripper for a 40 MM grenade cartridge as recited in claim 1 wherein said connecting plate member is fabricated of 20% fiberglass reinforced acetyl homopolymer thermoplastic resin.

9. The carrier and stripper for a 40 MM grenade cartridge as recited in claim 1 wherein said connecting plate member is attached to said channel shaped right side member bottom leg and said channel shaped left side member bottom leg with a plurality of threaded fasteners.

10. The carrier and stripper for a 40 MM grenade cartridge as recited in claim 1 wherein said at least one retaining and release member consist of a plurality of wire form stripper springs attached to both channel shaped right side member top leg and channel shaped right side member bottom leg and said channel shaped left side member top leg and channel shaped left side member bottom leg, wherein each wire form stripper spring is attached with threaded fasteners.

11. The carrier and stripper for a 40 MM grenade cartridge as recited in claim 1 wherein said at least one retaining and release member further comprise a leaf spring.

12. The carrier and stripper for a 40 MM grenade cartridge as recited in claim 11 wherein said leaf spring is attached with threaded fasteners.

13. The carrier and stripper for a 40 MM grenade cartridge as recited in claim 1 wherein said attaching means for fastening the carrier and stripper to a person is a spring loaded wire form clasp.

14. The carrier and stripper for a 40 MM grenade cartridge as recited in claim 1 wherein said attaching means for fastening the carrier and stripper to a person is hook and loop material with a plurality of straps attached to a material mat.

15. A carrier and stripper for a 40 MM grenade cartridge which comprises:

a channel shaped right side member having a closed end, an open end, a top leg, a bottom leg and a web, a channel shaped left side member having a closed end and a open end, a top leg, a bottom leg and a web with each of said legs facing said legs of said right side member with said webs spaced at a predetermined distance, a separate and distinct connecting plate member attaching said right side member to said left side member on facing bottom legs, at least one retaining and release member having a configuration to retain a plurality of 40 MM grenade cartridges between said right side member and said left side member, and each closed end until released by manually pulling out one of said grenade cartridges from an end opposite each closed end, and attaching means for fastening said carrier and stripper to a person wherein said attaching means for fastening the carrier and stripper directly to a person is a belt clip.

* * * * *